US008934793B2

(12) United States Patent
Furukawa

(10) Patent No.: US 8,934,793 B2
(45) Date of Patent: Jan. 13, 2015

(54) TONER-STATE PREDICTING DEVICE, METHOD, AND STORAGE MEDIUM

(71) Applicant: Fuji Xerox Co., Ltd., Minato-ku, Tokyo (JP)

(72) Inventor: Shigehiro Furukawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 37 days.

(21) Appl. No.: 13/745,150

(22) Filed: Jan. 18, 2013

(65) Prior Publication Data

US 2014/0010559 A1 Jan. 9, 2014

(30) Foreign Application Priority Data

Jul. 9, 2012 (JP) ..... 2012-153466

(51) Int. Cl.
*G03G 15/00* (2006.01)
*G03G 21/00* (2006.01)

(52) U.S. Cl.
USPC ..... 399/34; 399/36; 399/120

(58) Field of Classification Search
USPC ..... 399/34, 36, 99, 120, 359
See application file for complete search history.

(56) References Cited

U.S. PATENT DOCUMENTS

| | | | | |
|---|---|---|---|---|
| 6,167,211 | A | 12/2000 | Oogi et al. | |
| 6,539,182 | B2 * | 3/2003 | Friedrich | 399/27 |
| 2002/0141768 | A1 * | 10/2002 | Friedrich | 399/31 |
| 2005/0041998 | A1 * | 2/2005 | Fujii et al. | 399/258 |
| 2005/0058475 | A1 * | 3/2005 | Tsurusaki | 399/358 |
| 2012/0114349 | A1 * | 5/2012 | Matsumoto et al. | 399/53 |
| 2013/0129366 | A1 * | 5/2013 | Furukawa | 399/34 |

FOREIGN PATENT DOCUMENTS

| | | | |
|---|---|---|---|
| JP | 05-100566 | A | 4/1993 |
| JP | 2000-089635 | A | 3/2000 |
| JP | 2010-122537 | A | 6/2010 |

* cited by examiner

*Primary Examiner* — Francis Gray
(74) *Attorney, Agent, or Firm* — Sughrue Mion, PLLC

(57) ABSTRACT

A toner-state predicting device includes a changing unit that changes a rotation speed of a stepping motor that drives a toner recovery mechanism in an image forming apparatus; a detecting unit that detects presence of synchronization loss of the stepping motor at the changed rotation speed; and a predicting unit that predicts toner clogging which will occur in future in the toner recovery mechanism, based on the rotation speed changed by the changing unit and the presence of the synchronization loss detected by the detecting unit.

4 Claims, 10 Drawing Sheets

TONER-STATE PREDICTING DEVICE, METHOD, AND STORAGE MEDIUM

CROSS-REFERENCE TO RELATED APPLICATIONS

This application is based on and claims priority under 35 USC 119 from Japanese Patent Application No. 2012-153466 filed Jul. 9, 2012.

BACKGROUND

The present invention relates to a toner-state predicting device, a toner-state predicting method, and a storage medium.

SUMMARY

According to an aspect of the invention, there is provided a toner-state predicting device including a changing unit that changes a rotation speed of a stepping motor that drives a toner recovery mechanism in an image forming apparatus; a detecting unit that detects presence of synchronization loss of the stepping motor at the changed rotation speed; and a predicting unit that predicts toner clogging which will occur in future in the toner recovery mechanism, based on the rotation speed changed by the changing unit and the presence of the synchronization loss detected by the detecting unit.

BRIEF DESCRIPTION OF THE DRAWINGS

An exemplary embodiment of the present invention will be described in detail based on the following figures, wherein.

DETAILED DESCRIPTION

An exemplary embodiment of the invention is described with reference to the drawings.

An image forming apparatus including a toner-state predicting device according to the exemplary embodiment of the invention is described first.

The image forming apparatus is, for example, a copier, a facsimile, a printer, or a multi-function machine with a combination of these functions, having an image forming function that forms an image on a recording material such as paper with toner.

Figure 7:
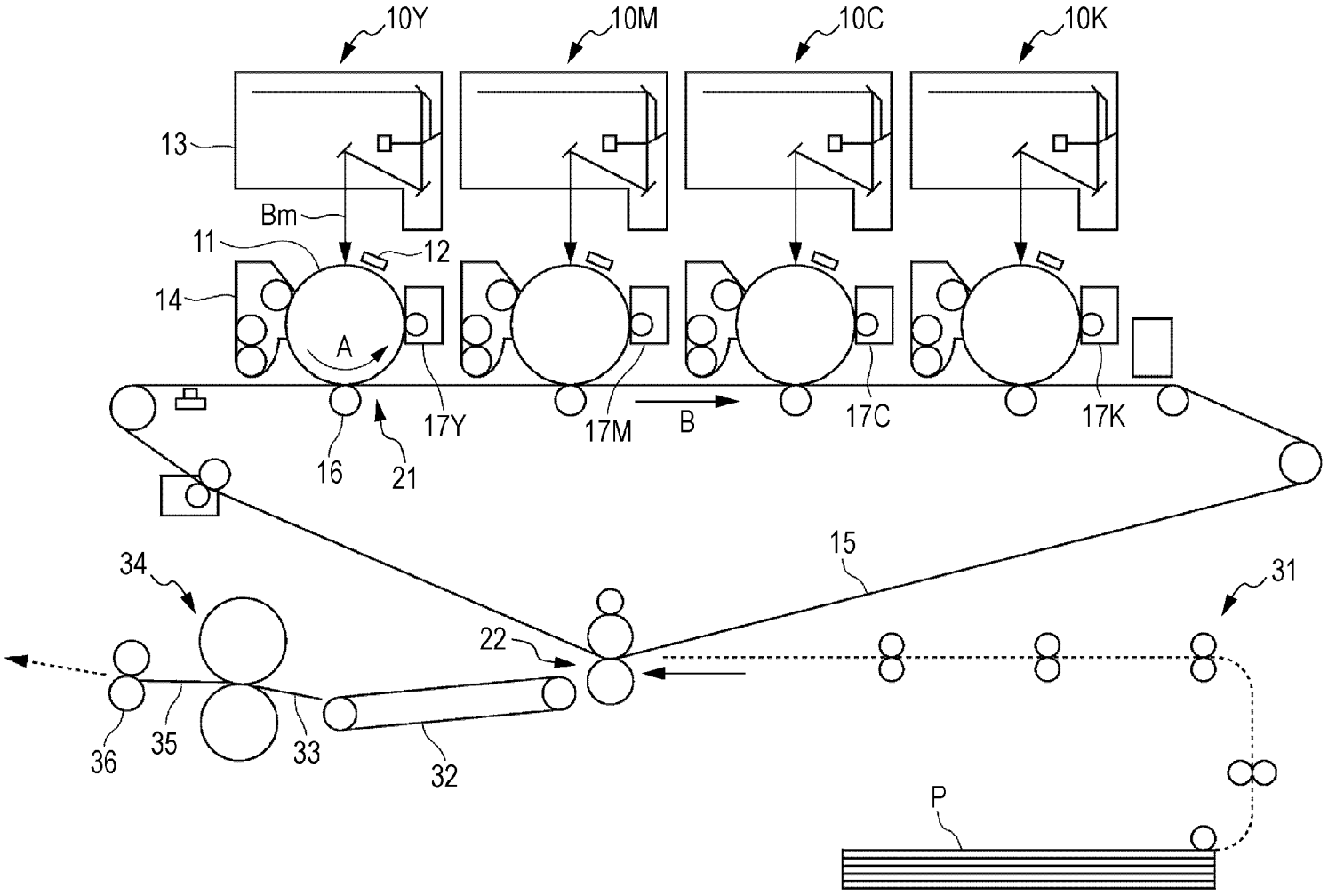
FIG. 7 illustrates an example of an apparatus structure relating to an image forming function of an image forming apparatus.

FIG. 7 illustrates an example apparatus structure relating to the image forming function of the image forming apparatus.

The illustrated image forming apparatus employs an intermediate transfer system generally called tandem type. Representative function units include plural image forming units 10Y, 10M, 10C, and 10K that form toner images of respective color components by an electrophotographic system, first transfer units 21 that successively transfer (first transfer) the toner images of the respective color components formed by the image forming units 10Y, 10M, 10C, and 10K onto an intermediate transfer belt 15, which rotates in a direction indicated by arrow B in FIG. 7, a second transfer unit 22 that collectively transfers (second transfer) the superposed toner images transferred on the intermediate transfer belt 15 onto paper P (an example of a recording material), and a fixing unit 34 that fixes the second-transferred image to the paper P.

Each of the image forming units 10Y, 10M, 10C, and 10K includes a photoconductor drum 11 that rotates in a direction indicated by arrow A in FIG. 7. Also, various electrophotographic devices, including a charging unit 12 that electrically charges the photoconductor drum 11, an exposure unit 13 that writes an electrostatic latent image on the photoconductor drum 11 by irradiating the photoconductor drum 11 with an exposure beam Bm, a developing unit 14 that houses toner of a corresponding color component and forms a toner image by developing the electrostatic latent image on the photoconductor drum 11 with the toner so that the electrostatic latent image becomes a visible image, a first transfer roller 16 that transfers the toner image of the corresponding color component formed on the photoconductor drum 11 onto the intermediate transfer belt 15 in a superposed manner at the first transfer unit 21, and a drum cleaner 17 (17Y, 17M, 17C, 17K) that removes residual toner on the photoconductor drum 11, are arranged around each of the photoconductor drums 11 in that order.

The image forming units 10Y, 10M, 10C, and 10K are arranged in a substantially straight line in order of yellow (Y), magenta (M), cyan (C), and black (K) from the upstream side of the intermediate transfer belt 15. The image forming units 10Y, 10M, 10C, and 10K may come into contact with and be separated from the intermediate transfer belt 15.

Also, the illustrated image forming apparatus includes a paper feed mechanism 31 that serves as a paper transport system and performs a paper feed operation of taking paper P from a paper housing and feeding the paper P to the second transfer unit 22, a transport belt 32 that transports the paper P passing through the second transfer unit 22 toward the fixing unit 34, a fixing entrance guide 33 that guides the paper P to the entrance of the fixing unit 34, a paper output guide 35 that guides the paper P output from the fixing unit 34, and a paper output roller 36 that outputs the paper P guided by the paper output guide 35 to the outside of the apparatus.

That is, the paper P fed by the paper feed mechanism 31 from the paper housing to the second transfer unit 22 receives the toner image on the intermediate transfer belt 15 at the second transfer unit 22 by electrostatic transferring, and then is transported to the transport belt 32 while being separated from the intermediate transfer belt 15. Then, the paper P is transported by the transport belt 32 to the fixing unit 34 through the fixing entrance guide 33 in accordance with the operation speed of the fixing unit 34. The unfixed toner image on the paper P transported to the fixing unit 34 is fixed onto the paper P when the unfixed toner image receives fixing processing of heating and applying pressure by the fixing unit 34.

Then, the paper P with the fixed image formed is transported to an output paper housing (not shown) provided outside the apparatus through the paper output guide 35 and the paper output roller 36.

Each of the drum cleaners 17Y, 17M, 17C, and 17K removes the residual toner, which is no longer required, from the photoconductor drum 11. A toner recovery mechanism included in the image forming apparatus recovers the removed toner.

Figure 8:
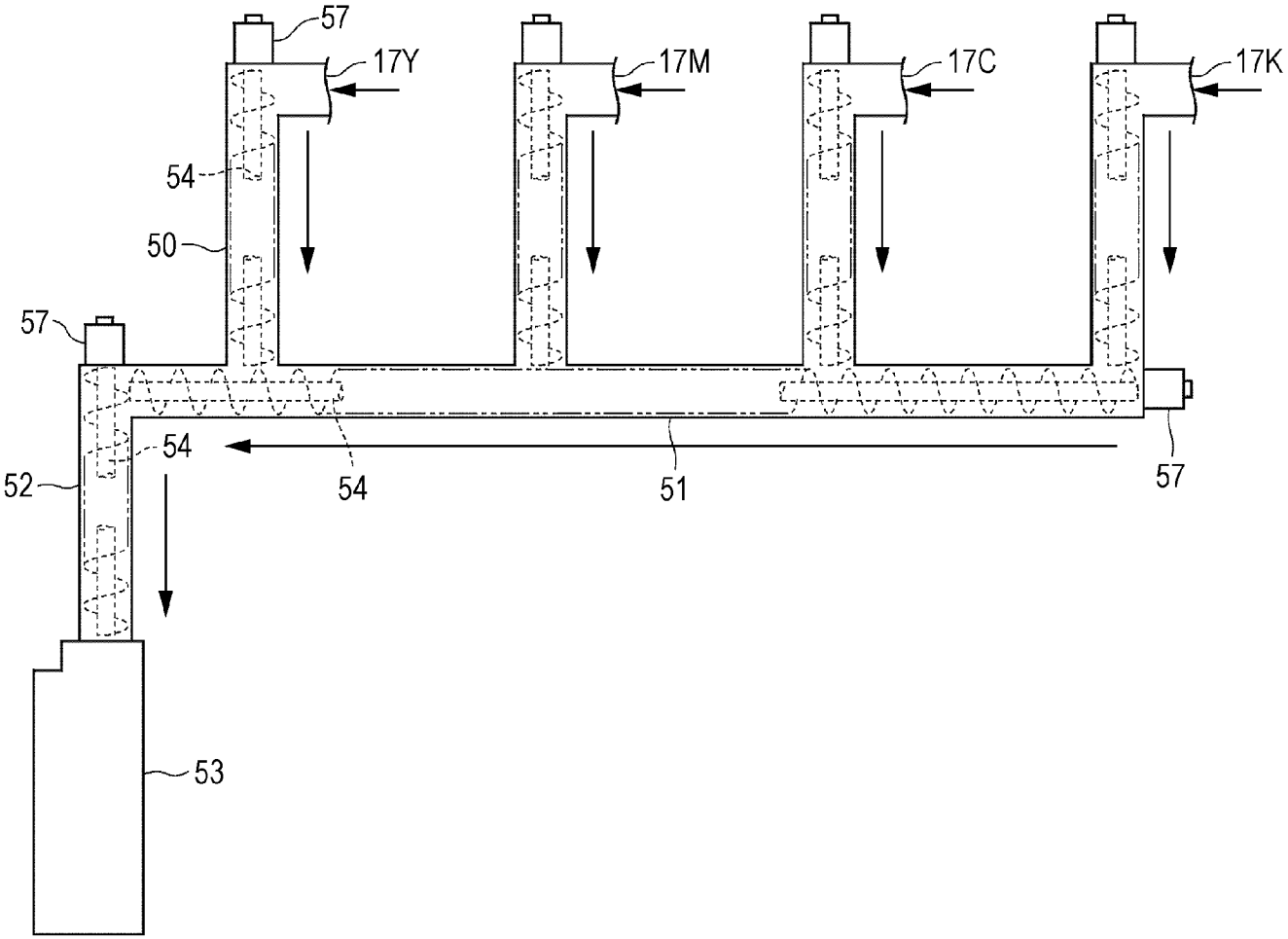
FIG. 8 illustrates a configuration example of a toner recovery mechanism of the image forming apparatus.

FIG. 8 illustrates a configuration example of the toner recovery mechanism. Also, FIG. 9 illustrates part of FIG. 8 in an enlarged manner.

The toner recovery mechanism is arranged inside a housing of the image forming apparatus. The toner recovery mechanism includes plural cylindrical toner recovery paths 50 having upper ends respectively coupled with the drum cleaners 17Y, 17M, 17C, and 17K and extending in the vertical direction, a cylindrical toner recovery path 51 coupled with lower ends of the toner recovery paths 50 and extending in the horizontal direction, a cylindrical toner recovery path 52 having an upper end coupled with an end of the toner recovery path 51 and extending in the vertical direction, and a toner recovery bottle 53 coupled with a lower end of the toner recovery path 52.

That is, the toner recovery paths 50 to 52 form toner recovery paths extending from the drum cleaners 17Y, 17M, 17C, and 17K to the toner recovery bottle 53.

Figure 9:
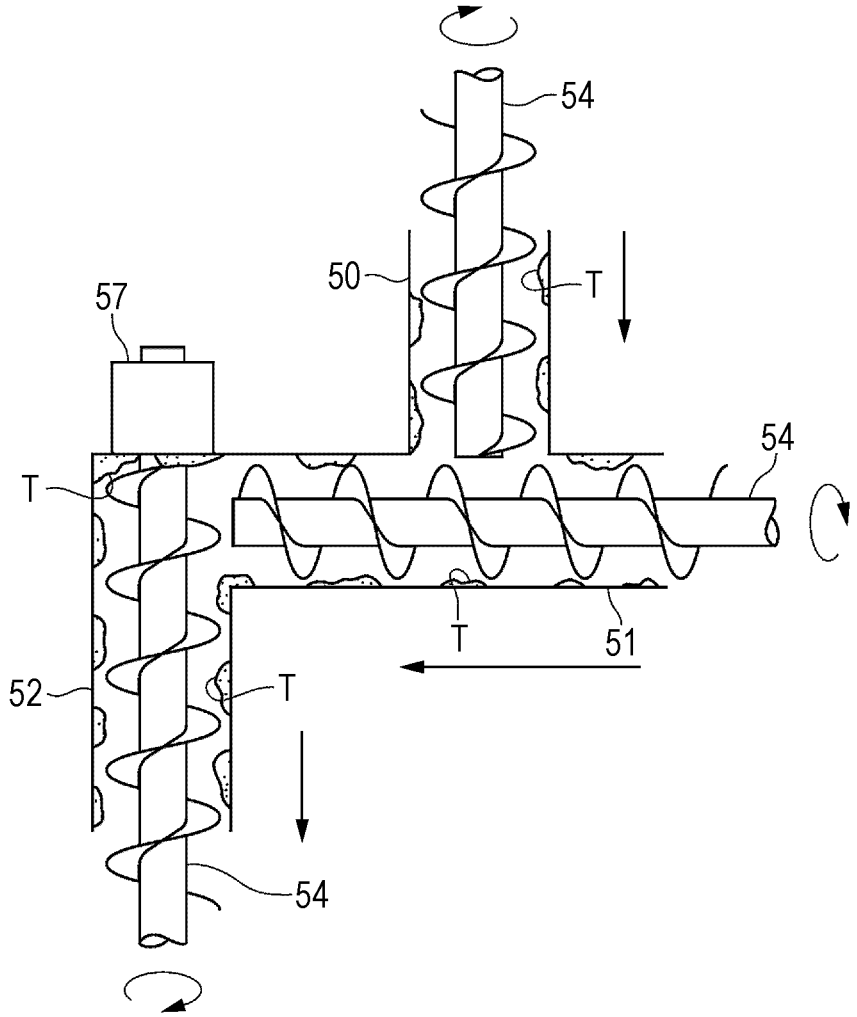
FIG. 9 is an enlarged view of part of FIG. 8.

The toner recovery paths 50 to 52 respectively house helical shafts (augers) 54 that have helical collars as specifically shown in FIG. 9 rotatably around the axis. Motors 57 are respectively provided at ends of the helical shafts 54. In this exemplary embodiment, each motor 57 is a stepping motor.

As shown in FIGS. 8 and 9, when the motors 57 are operated under control of a controller (not shown), the helical shafts 54 are rotated, and hence the collars of the helical shafts 54 send the toner in the toner recovery paths 50 to 52, and the toner recovered from the drum cleaners 17Y, 17M, 17C, and 17K is transported to the toner recovery bottle 53 through the toner recovery paths.

Since the toner has small particles, as shown in FIG. 9, toner T, which is to be recovered, may adhere to inner walls of the toner recovery paths 50 to 52 and may stay therein. In recent years, since the definition of an image to be formed is desired to be increased, reduction in particle size of toner is progressed, and deterioration in fluidity tends to markedly appear. As the result, the toner likely stays and is likely clogged in the toner recovery paths 50 to 52.

If toner clogging occurs, the toner to be recovered flows backward. If the toner reaches the image forming unit, the toner may affect the quality of an output image. To reduce toner clogging, it is desirable to structurally prevent toner clogging from occurring. However, toner clogging does not always occur, and the occurrence position is not only a specific position. It is difficult to conceive a structural countermeasure.

Hence, maintenance for, for example, removing the clogging toner is required. To perform maintenance or a clogging avoiding operation at a proper timing while productivity is maintained, a situation in which toner clogging occurs, i.e., a fluidity deterioration state of the toner has to be previously detected.

The method of detecting the fluidity deterioration state in which toner clogging occurs may be a known method of detecting the fluidity deterioration state by obtaining a change in transport load of the toner. The load state of the transport load of the toner is obtained by detecting a current value of a driving motor for a transport operation.

The toner recovery mechanism in the image forming apparatus does not need complicated control, and a driving part of the toner recovery mechanism is generally based on open-loop control using a stepping motor driven by constant current. That is, the toner recovery mechanism using the stepping motor is provided with low cost and does not need complicated control. However, since feed-back control is not required, a mechanism that detects a load state is not included. Further, since the stepping motor is driven by constant current as described above, the torque and the current value do not exhibit linear changes.

As described above, with the toner recovery mechanism using the stepping motor, the transport load of the toner is not obtained from the change in current value of the motor. A configuration that predictively detects toner clogging (high-load state of toner transport) is required. If the stepping motor becomes a certain high-load state, synchronization loss is generated and the current value is increased. In this case, toner clogging is already generated and the state is in the high-load state. Hence, toner clogging is not predictively detected.

A characteristic of the stepping motor is described below.

The stepping motor rotates at rotation angle and speed corresponding to pulses (the frequency of pulses controls the speed, and the number of pulses controls the rotation angle). However, if a sudden change in speed or an overload is generated, the synchronization is lost, and the rotation angle and speed no longer correspond to the pulses. The state in which the synchronization is lost is called synchronization loss. If synchronization loss is generated, restoring to the synchronization state by the stepping motor is difficult.

Figure 10A:
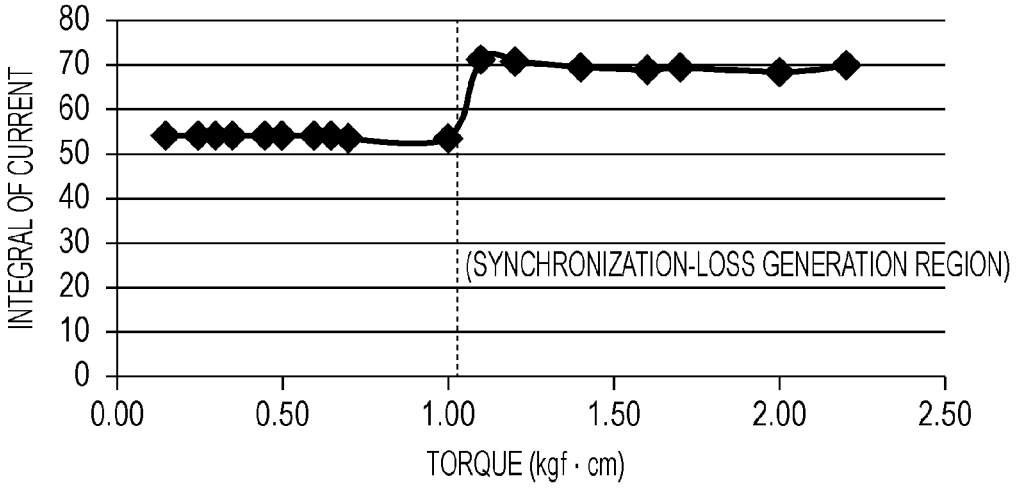
FIGS. 10A and 10B each illustrate an example of the relationship between the torque of the stepping motor and the integral of current.

Also, the stepping motor does not have a linear relationship between the torque and the current value whereas a servomotor has a linear relationship between the torque and the current value. FIG. 10A illustrates an example relationship between the torque and the integral of current of the stepping motor. Referring to FIG. 10A, the integral of current is stable around 54 in a range until the torque is around 1 (kgf·cm). In a range around the torque exceeds 1 (kgf·cm), the integral of current suddenly increases, and then is stable around 70. Synchronization loss is generated in the stepping motor when the change appears. As described above, the presence of synchronization loss is recognized by watching the current value of the stepping motor.

Figure 10B:
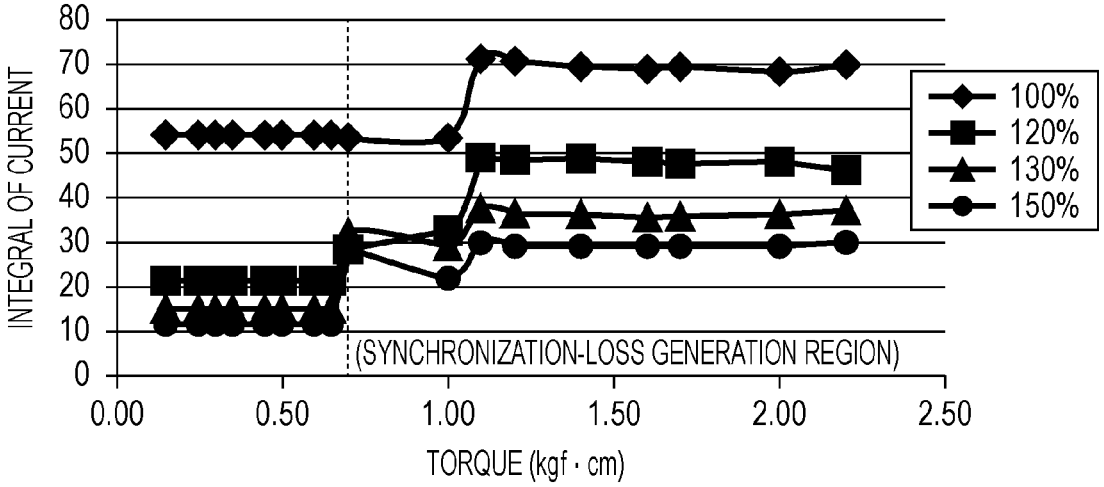

Also, the torque that causes synchronization loss to be generated in the stepping motor varies depending on the rotation speed of the stepping motor. FIG. 10B illustrates an example relationship between the torque and the integral of current for each of plural rotation speeds. As shown in FIG. 10B, as the speed is higher, synchronization loss is generated with a lower torque. That is, the stepping motor has a characteristic that the limit torque is decreased as the rotation speed becomes higher.

In the image forming apparatus according to the exemplary embodiment, by using the characteristic of the stepping motor, toner clogging in the toner recovery mechanism is previously detected, and the allowance period until the limit value is predicted.

Figure 1:
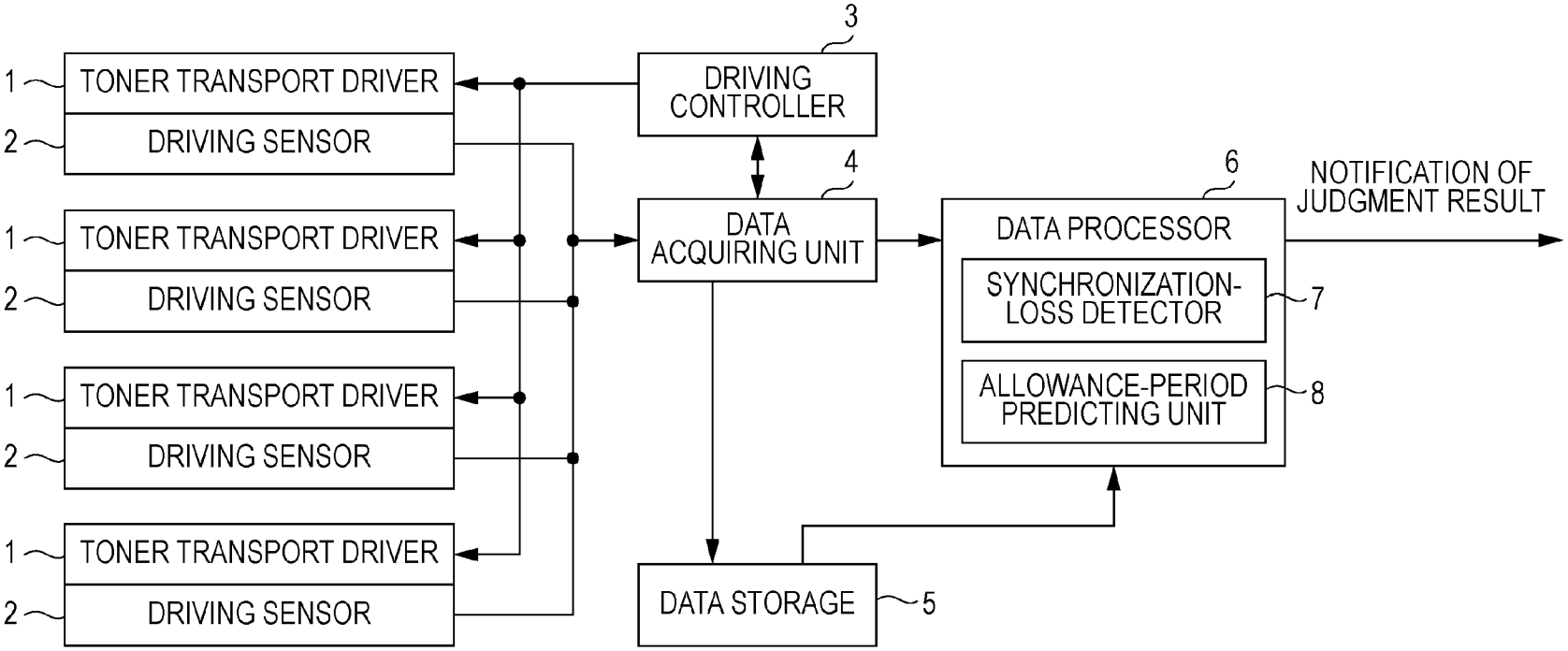
FIG. 1 illustrates an example of a function block of a toner-state predicting device according to an exemplary embodiment of the invention.

FIG. 1 illustrates an example of a function block of the toner-state predicting device that judges whether or not toner clogging occurs in the toner recovery mechanism.

The toner-state predicting device according to this exemplary embodiment includes plural toner transport drivers 1, plural driving sensors 2, a driving controller 3, a data acquiring unit 4, a data storage 5, and a data processor 6.

The toner transport drivers 1 are driving sources of the toner recovery mechanism, and correspond to the stepping motors 57 that rotate the helical shafts 54 provided in the toner recovery paths 50 to 52.

The driving sensors 2 are function units that detect the driving states of the stepping motors 57 which are the toner transport drivers 1. The driving sensors 2 are respectively provided for the stepping motors 57. In this exemplary embodiment, each of the driving sensors 2 detects driving current of the corresponding stepping motor 57 as the driving state of the stepping motor 57, and outputs driving-state data containing the detected value.

The driving controller 3 controls the rotation speeds of the stepping motors 57 which are the toner transport drivers 1, in plural phases.

In this exemplary embodiment, the rotation speed of the stepping motor 57 when the toner recovery mechanism is normally operated is determined as a reference rotation speed. The driving controller 3 provides control that changes the rotation speed to a first rotation speed being higher than the reference rotation speed, and to a second rotation speed being higher than the reference rotation speed and lower than the first rotation speed. That is, the driving controller 3 changes the rotation speed to the first rotation speed at which the limit torque is lower than that at the reference rotation speed (a rotation speed at which synchronization loss is more likely generated as compared with the reference rotation speed), and to the second rotation speed at which the limit torque is lower than that at the reference rotation speed and is higher than that at the first rotation speed (a rotation speed at which synchronization loss is more likely generated as compared with the reference rotation speed but is less likely generated as compared with the first rotation speed).

The reference rotation speed, the first rotation speed, and the second rotation speed may be common to the stepping motors 57. In this exemplary embodiment, however, the reference rotation speed, the first rotation speed, and the second rotation speed are set depending on the toner recovery paths 50 to 52 at which the stepping motors 57 are arranged.

The data acquiring unit 4 acquires driving-state data from each of the driving sensors 2.

The data storage 5 stores the driving-state data acquired by the data acquiring unit 4. In this exemplary embodiment, time information is added to the driving-state data, and the driving-state data is stored as time-series data.

The data processor 6 has a synchronization-loss detector 7 and an allowance-period predicting unit 8.

The synchronization-loss detector 7 detects synchronization loss based on the driving-state data acquired by the data acquiring unit 4 (stored in the data storage 5) for each of the stepping motors 57 which are the toner transport drivers 1. In this exemplary embodiment, the current value of each stepping motor 57 contained in the driving-state data is compared with a predetermined threshold (upper limit of a current value during normal operation). If the current value of the stepping motor 57 exceeds the threshold, it is judged that synchronization loss is generated in the stepping motor 57.

Alternatively, synchronization loss of the stepping motor 57 may be detected by another method. In particular, for example, an encoder is provided at the rotation shaft of the stepping motor 57, the driving sensor 2 detects a count value of the encoder as the driving state of the stepping motor 57, and the driving sensor 2 outputs driving-state data containing the value. Then, the data processor 6 acquires the number of pulses fed to the stepping motor 57, compares the number of pulses with the count value of the encoder contained in the driving-state data, and if mismatching occurs between the number of pulses and the count value of the encoder (if the count value of the encoder is markedly decreased), it is judged that synchronization loss is generated.

The allowance-period predicting unit 8 calculates an allowance period until toner clogging occurs in the mechanism part (any of the toner recovery paths 50 to 52) corresponding to the stepping motor 57, based on the relationship between a timing at which synchronization loss is generated in the stepping motor 57 at the first rotation speed and a timing at which synchronization loss is generated in the stepping motor 57 at the second rotation speed. The processing is described later in detail.

The operation of the toner-state predicting device is described.

Figure 2A:
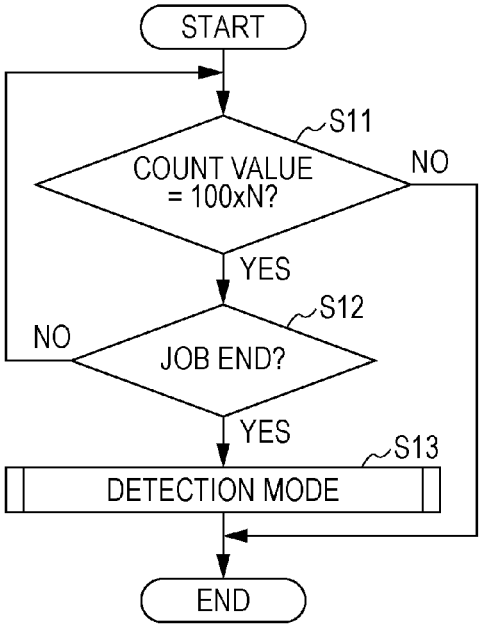
FIGS. 2A and 2B each illustrate an example of an operation flow of the toner-state predicting device.
Figure 2B:
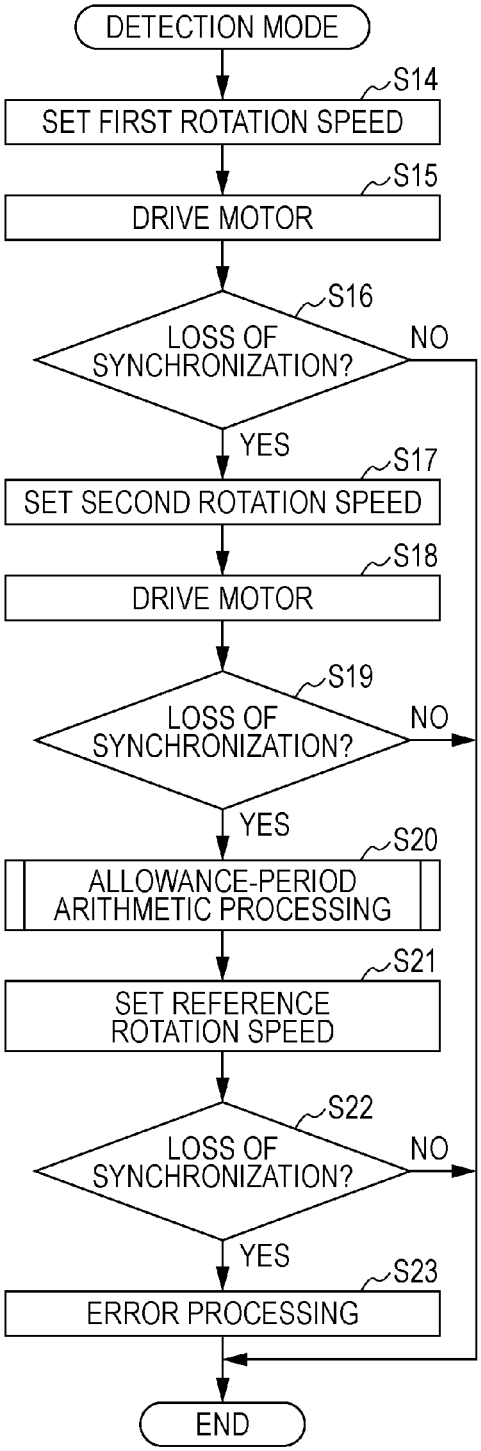

FIGS. 2A and 2B each illustrate an example of an operation flow of the toner-state predicting device. In this example, each of the stepping motors 57 is normally driven at the reference rotation speed.

The number of sheets which have images formed by the image forming apparatus and are output (number of output pages) is counted, and it is judged whether or not output is made by a predetermined number of sheets (in this example, 100 sheets) (step S11).

If it is judged that the output is made by the predetermined number of sheets, it is judged whether or not a job is ended (step S12). A job is a processing unit containing output of image by at least one sheet.

If it is judged that the job is ended, the operation enters a detection mode (step S13).

That is, the operation enters the detection mode every output of image formation by 100 sheets. The detection mode does not interrupt the job. The operation enters the detection mode in an intermission of jobs.

In the detection mode, the following operation is performed for each of the stepping motors 57.

First, the driving controller 3 sets the rotation speed of the stepping motor 57 to the first rotation speed that is higher than the reference rotation speed by two phases and drives the stepping motor 57 (steps S14, S15). The synchronization-loss detector 7 references the driving-state data output from the driving sensor 2 and checks the presence of synchronization loss at the first rotation speed (step S16).

If synchronization loss at the first rotation speed is detected in step S16, the driving controller 3 sets the rotation speed of the stepping motor 57 to the second rotation speed that is higher than the reference rotation speed by one phase (steps S17, S18). The synchronization-loss detector 7 references the driving-state data output from the driving sensor 2 and judges the presence of synchronization loss at the second rotation speed (step S19).

If it is judged that synchronization loss at the second rotation speed is present in step S19, the allowance-period predicting unit 8 calculates an allowance period (described later) (step S20). Also, the driving controller 3 sets the rotation speed of the stepping motor 57 to the reference rotation speed and drives the stepping motor 57 (step S21). The synchronization-loss detector 7 references the driving-state data output from the driving sensor 2 and checks the presence of synchronization loss at the reference rotation speed (step S22).

If it is judged that synchronization loss at the reference rotation speed is present in step S22, error processing is performed (step S23). In the error processing, for example, information indicative of that toner clogging occurs in the mechanism part (any of the toner recovery paths 50 to 52) corresponding to the stepping motor 57 with synchronization loss detected is displayed to notify a user of the image forming apparatus about the information, or the information is transmitted to an external device (for example, a monitoring server) and is displayed to notify an administrator or a person in charge of maintenance about the information and to urge the person for quick treatment.

In each of steps S16, S19, and S22, if it is judged that synchronization loss is not generated at each rotation speed, the detection mode is ended, and the operation returns to the normal operation. At this time, the rotation speed of each stepping motor 57 is restored to the reference rotation speed.

The notification to the user etc. may be made if it is judged that synchronization loss at the first rotation speed is present, i.e., if it is judged that a predictive phenomenon of toner clogging is present. Accordingly, a countermeasure to prevent toner clogging from occurring may be conceived, and preparation for quick treatment when toner clogging occurs may be made.

The calculation of the allowance-period predicting unit 8 is described.

Figure 3:
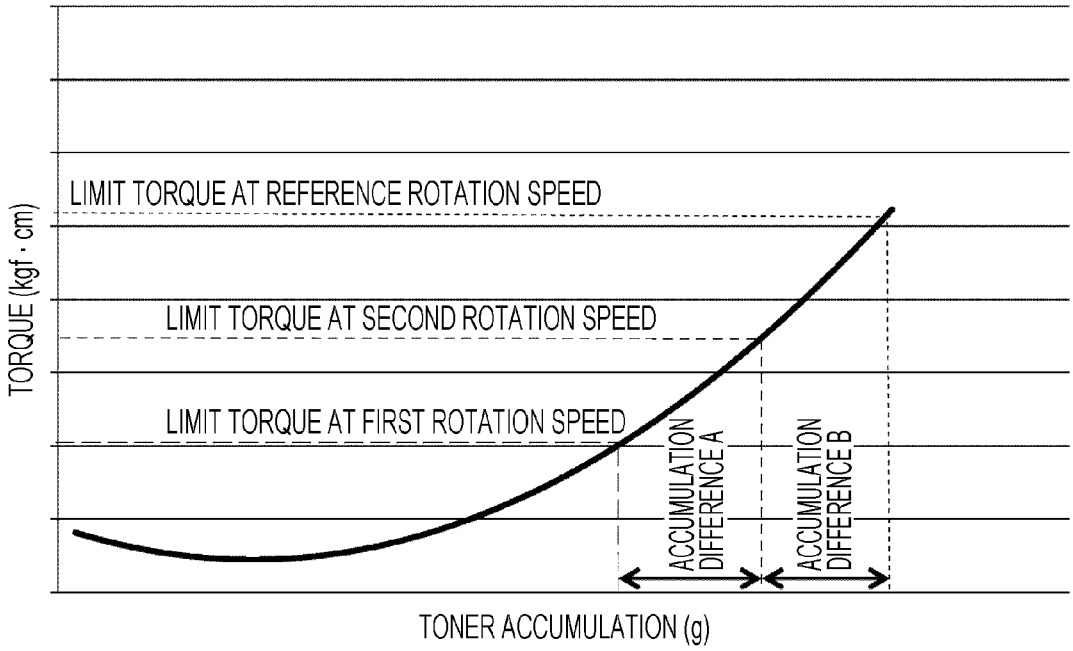
FIG. 3 illustrates an example of a regression curve indicative of the change in torque with respect to the toner accumulation.

The relationship between the torque of the stepping motor 57 and the toner accumulation in the mechanism part (any of the toner recovery paths 50 to 52) corresponding to the stepping motor 57 may be obtained through and experiment etc. The change in torque with respect to the toner accumulation may be expressed by a regression curve. FIG. 3 illustrates an example of a regression curve indicative of the change in torque with respect to the toner accumulation. The toner accumulation may be estimated from the regression curve and the current torque. However, a change with time of the toner accumulation depends on the usage of the apparatus. That is, the allowance period until the limit for a user with a large amount of toner discharge is different from the allowance period until the limit for a user with a small amount of toner discharge. Also, the way of toner clogging may vary among apparatuses.

Owing to this, the allowance-period predicting unit 8 according to this exemplary embodiment predicts the allowance period until the reference rotation speed with reference to a trend from excess of the limit torque at the first rotation speed to the limit torque at the second rotation speed (i.e., from a timing at which synchronization loss at the first rotation speed is generated to a timing at which synchronization loss at the second rotation speed is generated).

For example, reference sing Ta represents a period from excess of the limit torque at the first rotation speed to the limit torque at the second rotation speed, Tb represents a period from excess of the limit torque at the second rotation speed to the limit torque at the reference rotation speed, Da represents a difference between a toner accumulation with the limit torque at the first rotation speed and a toner accumulation with the limit torque at the second rotation speed, and Db represents a difference between a toner accumulation with the limit torque at the second rotation speed and a toner accumulation with the limit torque at the reference rotation speed. Then, the allowance period Tb may be calculated through the following arithmetic expression, Permission period $Tb$=period $Ta$×(accumulation difference $Db$/accumulation difference $Da$).

If the toner accumulation with the limit torque at each of the rotation speeds is previously measured through an experiment etc., accumulation difference Db/accumulation difference Da may be constant. The allowance period Tb may be obtained by measuring the period Ta and substituting the value into the above arithmetic expression.

Figure 4A:
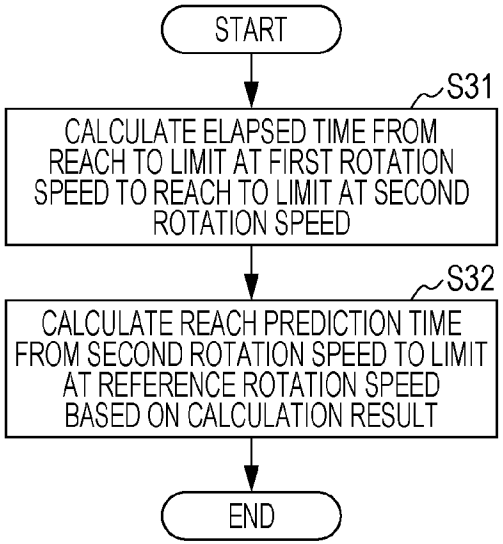
FIGS. 4A to 4C each illustrate an example of a processing flow for calculating an allowance period.

FIG. 4A illustrates an example processing flow of calculating the allowance period by using an elapsed time (the period Ta) from excess of the limit torque at the first rotation speed to the limit torque at the second rotation speed.

First, the elapsed time from reach to the limit torque at the first rotation speed (generation of synchronization loss) to reach to the limit torque at the second rotation speed (generation of synchronization loss) is calculated (step S31). Based on the calculation result, a reach prediction time (the allowance period) from reach to the limit torque at the second rotation speed (generation of synchronization loss) to reach to the limit torque at the reference rotation speed (generation of synchronization loss) is calculated (step S32).

Alternatively, the allowance period may be calculated by another method.

Figure 4B:
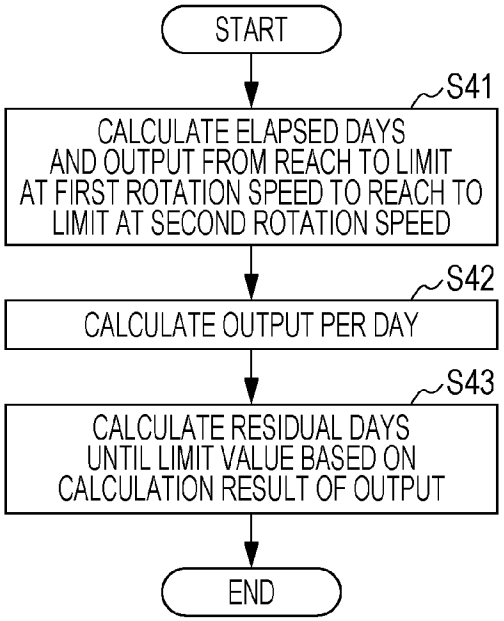

FIG. 4B illustrates an example processing flow of calculating the allowance period by using elapsed days and an output (the number of output sheets) from excess of the limit torque at the first rotation speed to the limit torque at the second rotation speed.

First, the elapsed days and the output from reach to the limit torque at the first rotation speed (generation of synchronization loss) to reach to the limit torque at the second rotation speed (generation of synchronization loss) is calculated (step S41). Then, an output per day is calculated (step S42). Based on the calculation result, the number of residual days (the allowance period) from reach to the limit torque at the second rotation speed (generation of synchronization loss) to reach to the limit torque at the reference rotation speed (generation of synchronization loss) is calculated (step S43).

That is, a toner accumulation per day is estimated based on the output per day (the number of output sheets). Hence, the number of residual days may be obtained by dividing the difference between the toner accumulation with the limit torque at the second rotation speed and the toner accumulation with the limit torque at the reference rotation speed by the output per day.

Figure 4C:
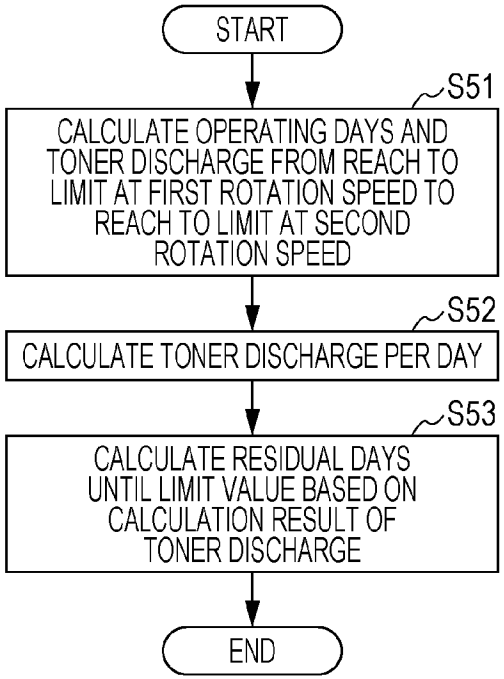

FIG. 4C illustrates an example processing flow of calculating the allowance period by using operating days and a toner discharge from excess of the limit torque at the first rotation speed to the limit torque at the second rotation speed.

First, the operating days and the toner discharge from reach to the limit torque at the first rotation speed (generation of synchronization loss) to reach to the limit torque at the second rotation speed (generation of synchronization loss) is calculated (step S51). Then, a toner discharge per day is calculated (step S52). Based on the calculation result, the number of residual days (the allowance period) from reach to the limit torque at the second rotation speed (generation of synchronization loss) to reach to the limit torque at the reference rotation speed (generation of synchronization loss) is calculated (step S53).

That is, the number of residual days may be obtained by dividing the difference between the toner accumulation with the limit torque at the second rotation speed and the toner accumulation with the limit torque at the reference rotation speed by the toner accumulation per operating day.

Alternatively, the allowance period may be calculated by another method. For example, an areal percentage of an image for every output and every color is calculated, a toner consumption is calculated, and the allowance period may be calculated from the result. This may be realized by a method similar to prediction for replacement of a toner cartridge after the toner amount in a toner cartridge becomes below a reference value.

In the above description, the allowance period is predicted after the operation shifts to the detection mode every time when the count value for the number of output sheets exceeds a predetermined amount (for example, 100 sheets). However, the detection mode may not be provided.

Figure 5:
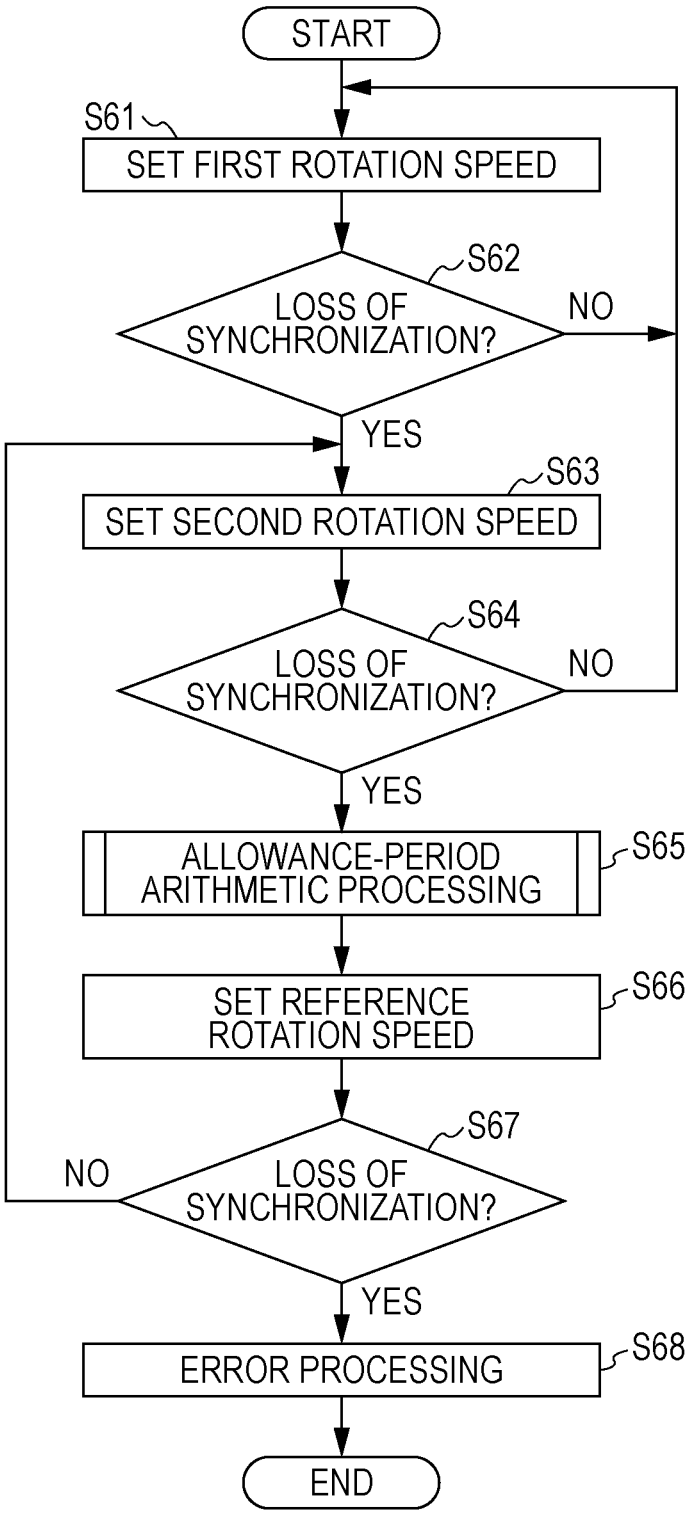
FIG. 5 illustrates another example of an operation flow of the toner-state predicting device.

FIG. 5 illustrates an example of an operation flow when the detection mode is not provided.

In this example, each stepping motor 57 is normally driven at the first rotation speed (step S61). The synchronization-loss detector 7 references the driving-state data output from the driving sensor 2, and checks the presence of synchronization loss at the first rotation speed during normal operation at the first rotation speed (S62).

If synchronization loss at the first rotation speed is detected in step S62, the driving controller 3 sets the rotation speed of the stepping motor 57 to the second rotation speed that is higher than the reference rotation speed by one phase (step S63). The synchronization-loss detector 7 references the driving-state data output from the driving sensor 2 and judges the presence of synchronization loss at the second rotation speed (step S64).

If it is judged that synchronization loss at the second rotation speed is present in step S63, the allowance-period predicting unit 8 calculates an allowance period (step S65). Also, the driving controller 3 sets the rotation speed of the stepping motor 57 to the reference rotation speed and drives the stepping motor 57 (step S66). The synchronization-loss detector 7 references the driving-state data output from the driving sensor 2 and checks the presence of synchronization loss at the reference rotation speed (step S67).

If it is judged that synchronization loss at the reference rotation speed is present in step S67, error processing is performed (step S68). In the error processing, for example, information indicative of that toner clogging occurs in the mechanism part (any of the toner recovery paths 50 to 52) corresponding to the stepping motor 57 with synchronization loss detected is displayed to notify a user of the image forming apparatus about the information, or the information is transmitted to another device (for example, a managing device) and is displayed to notify an administrator or a person in charge of maintenance about the information and to urge the person for quick treatment.

In step S64, if it is judged that synchronization loss at the second rotation speed is not present, the operation returns to step S61, and the rotation speed of the stepping motor 57 is set to the first rotation speed. This is because clogging may be eliminated already.

In step S67, if it is judged that synchronization loss at the second rotation speed is not present, the operation returns to step S63, and the rotation speed of the stepping motor 57 is set to the second rotation speed.

As described above, since the normal operation is made at a rotation speed higher than the reference rotation speed, reduction in productivity due to the activation of the detection mode may be restricted.

Next, a method of determining each rotation speed is described.

First, toner is accumulated in the toner recovery path, a torque for transporting the toner is measured, and a change in torque with respect to the toner accumulation is obtained through an experiment etc.

Also, the limit torque for each rotation speed of the stepping motor 57 is measured through an experiment etc., and the limit torque for the rotation speed is obtained.

Figure 6A:
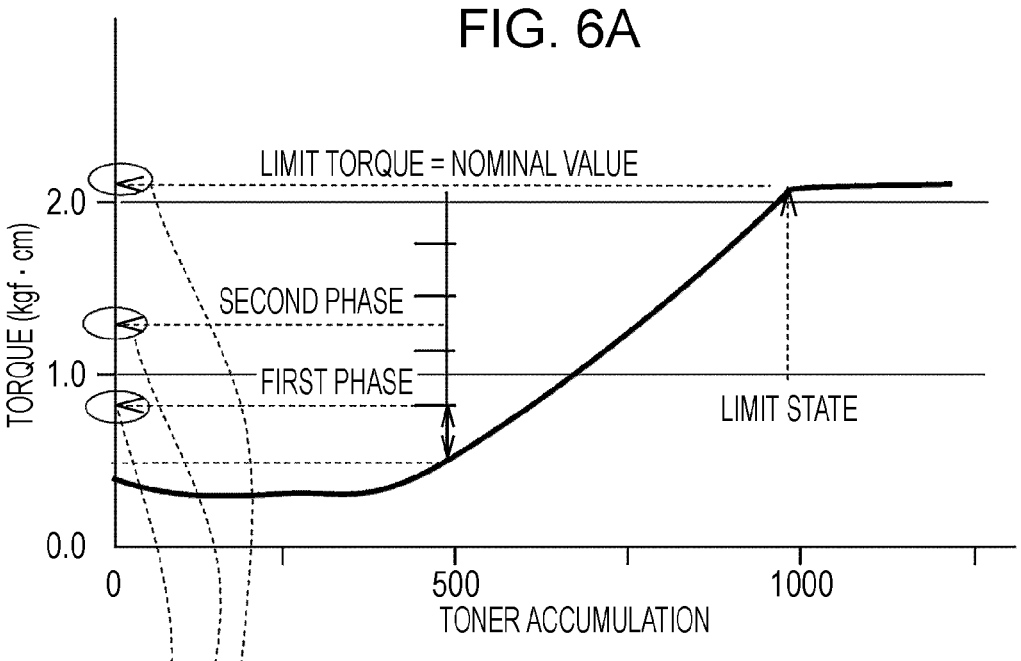
FIGS. 6A and 6B are each an illustration explaining a method of determining a rotation speed.
Figure 6B:
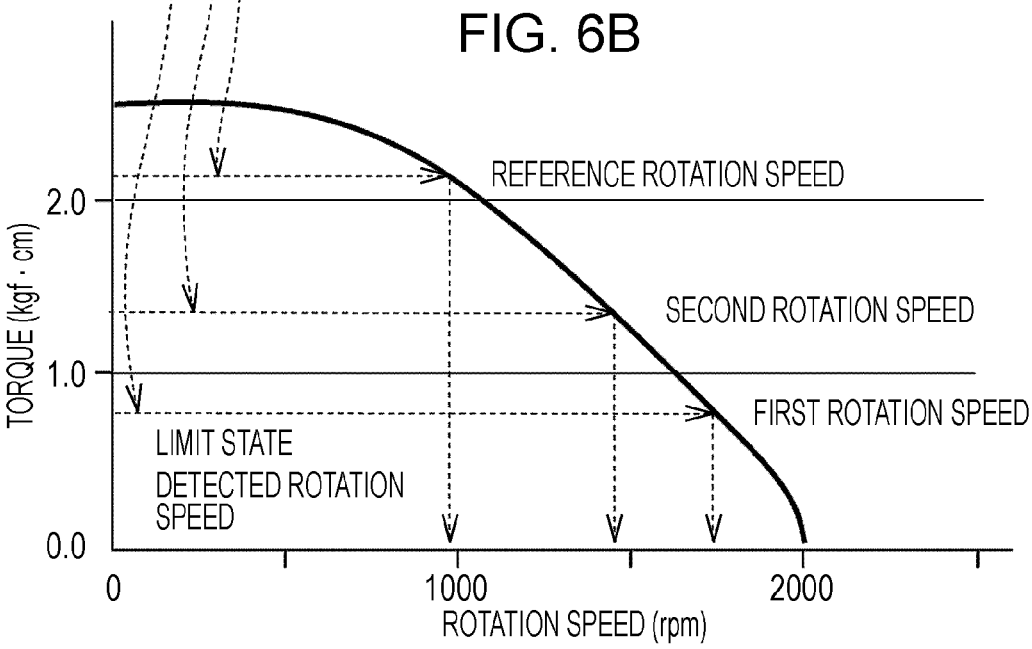

FIG. 6A illustrates an example of a graph which expresses the change in torque with respect to the toner accumulation. FIG. 6B illustrates an example of a graph which expresses the limit torque with respect to the rotation speed.

The torque when the toner accumulation reaches a limit state is measured, and the rotation speed corresponding to the torque at this time is determined as the reference rotation speed. Also, the rotation speed at a timing (first phase) at which the toner accumulation reaches 2/10 since the torque starts to be changed to of the limit is determined as the first rotation speed, and the rotation speed at a timing (second phase) at which the toner accumulation reaches 5/10 of the limit is determined as the second rotation speed.

In this way, the allowance period until the limit may be easily calculated.

It is to be noted that the ratios 2/10 and 5/10 are mere examples, and may be determined with regard to the reach time to the limit. For example, in an actual operation, if the allowance period from excess of the limit torque in the first phase to reach to the limit torque with the toner accumulation state in the limit state is about 10 days in an operation with the maximum toner discharge, maintenance may be efficiently scheduled.

The image forming apparatus according to the exemplary embodiment includes a computer having hardware sources. The hardware sources include a central processing unit (CPU) that performs various arithmetic processing, memories such as a random access memory (RAM) that is a work area of the CPU and a read only memory (ROM) that stores a basic control program, auxiliary memories such as a hard disk drive (HDD) that stores various programs and data, an input I/F that is an interface between a display device that displays various information and an input device such as operation buttons or a touch panel used for an input operation by a user, and a communication I/F that is an interface for making communication with another device in a wired or wireless manner.

A program according to the exemplary embodiment of the invention is read out from the auxiliary memory or the like, developed in the RAM, and executed by the CPU. Hence, the function of the toner-state predicting device according to the exemplary embodiment of the invention is realized on the computer.

In particular, the driving controller 3 realizes a function of a changing unit according to the exemplary embodiment of the invention, the synchronization-loss detector 7 realizes a function of a detecting unit according to the exemplary embodiment of the invention, and the allowance-period predicting unit 8 realizes a function of a predicting unit according to the exemplary embodiment of the invention.

The program according to the exemplary embodiment of the invention is set in the computer of the image forming apparatus, for example, such that the program is read from an external storage medium such as a compact disc-read-only memory (CD-ROM) storing the program, or the program is received through a communication network or the like.

The function units may not be realized by the software configuration like this exemplary embodiment, and the function units may be realized by dedicated hardware modules.

Also, in this exemplary embodiment, while the image forming apparatus includes the function units, such as the driving controller 3, the synchronization-loss detector 7, and the allowance-period predicting unit 8, the function units may be provided in an external device such as a monitoring server connected to the image forming apparatus in a communication available manner, and the external device may remotely control the rotation speed of each stepping motor 57 of the image forming apparatus and may receive the driving-state data at this time. The allowance period until toner clogging occurs may be predicted by checking the presence of synchronization loss at each rotation speed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner-state predicting device, comprising:

a changing unit configured to change a rotation speed of a stepping motor that drives a toner recovery mechanism in an image forming apparatus;

a detecting unit configured to detect presence of synchronization loss of the stepping motor at the changed rotation speed; and a predicting unit configured to predict toner clogging which will occur in future in the toner recovery mechanism, using the rotation speed changed by the changing unit and the presence of the synchronization loss detected by the detecting unit, wherein the predicting unit is configured to predict a timing at which the toner clogging occurs in the toner recovery mechanism using a relationship between a timing at which the synchronization loss is detected at a first rotation speed being higher than a reference rotation speed and a timing at which the synchronization loss is detected at a second rotation speed being higher than the reference rotation speed and lower than the first rotation speed.

2. The toner-state predicting device according to claim 1, wherein the predicting unit predicts the timing at which the toner clogging occurs in the toner recovery mechanism, if the synchronization loss is detected at a rotation speed being higher than the reference rotation speed.

3. A non-transitory computer readable medium storing a program causing a computer to realize functions, the functions comprising:

a changing function that changes a rotation speed of a stepping motor that drives a toner recovery mechanism in an image forming apparatus;

a detecting function that detects presence of synchronization loss of the stepping motor at the changed rotation speed; and a predicting function that predicts toner clogging which will occur in future in the toner recovery mechanism, using the rotation speed changed by the changing function and the presence of the synchronization loss detected by the detecting function, wherein the predicting function predicts a timing at which the toner clogging occurs in the toner recovery mechanism using a relationship between a timing at which the synchronization loss is detected at a first rotation speed being higher than a reference rotation speed and a timing at which the synchronization loss is detected at a second rotation speed being higher than the reference rotation speed and lower than the first rotation speed.

4. A toner-state predicting method, comprising:

changing a rotation speed of a stepping motor that drives a toner recovery mechanism in an image forming apparatus;

detecting presence of synchronization loss of the stepping motor at the changed rotation speed; and predicting toner clogging which will occur in future in the toner recovery mechanism, using the changed rotation speed and the detected presence of the synchronization loss, wherein the predicting comprises predicting a timing at which the toner clogging occurs in the toner recovery mechanism using a relationship between a timing at which the synchronization loss is detected at a first rotation speed being higher than a reference rotation speed and a timing at which the synchronization loss is detected at a second rotation speed being higher than the reference rotation speed and lower than the first rotation speed.

* * * * *